United States Patent [19]

Saint

[11] Patent Number: 4,573,224

[45] Date of Patent: Mar. 4, 1986

[54] FOLDING PLAYPEN

[75] Inventor: David Saint, Elverson, Pa.

[73] Assignee: Graco Metal Products Inc., Elverson, Pa.

[21] Appl. No.: 616,107

[22] Filed: Jun. 1, 1984

[51] Int. Cl.[4] ..... A47D 13/06

[52] U.S. Cl. ..... 5/99 C; 5/99 A

[58] Field of Search ..... 5/98 R, 98 A, 98 C, 5/99 R, 99 A, 99 C, 99 B, 98 B

[56] References Cited

U.S. PATENT DOCUMENTS 2,617,999 11/1952 Mitchell ..... 5/99 A
3,206,773 9/1965 Sarasin ..... 5/99 R
3,474,472 10/1969 Hamilton ..... 5/98 R
3,789,439 2/1974 Berg et al. ..... 5/99 C

*Primary Examiner*—Alexander Grosz
*Attorney, Agent, or Firm*—Seidel, Gonda, Goldhammer & Abbott

[57] ABSTRACT

A folding playpen having frame portions and platform sections which pivot in opposite directions as leg frames move between extended and collapsed positions. Angled links assisted by meshed gears on at least one pair of leg frames cause said pivotable movement to eliminate the problem of members pivoting inwardly when they should pivot outwardly.

9 Claims, 6 Drawing Figures

FIG. 3
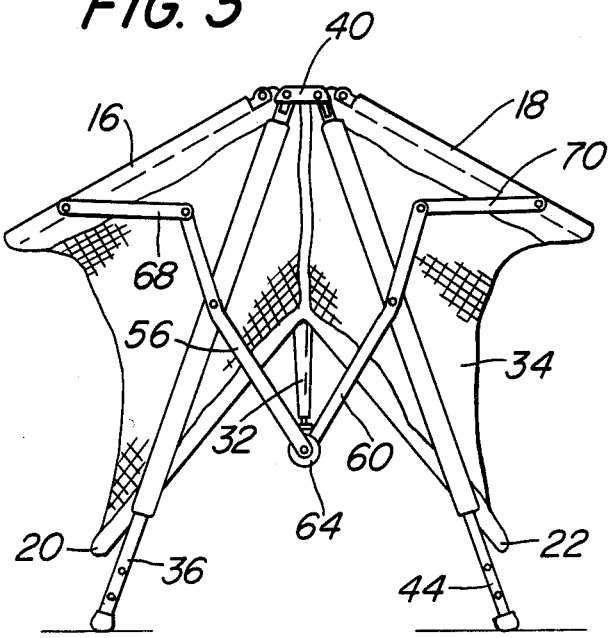
FIG. 4
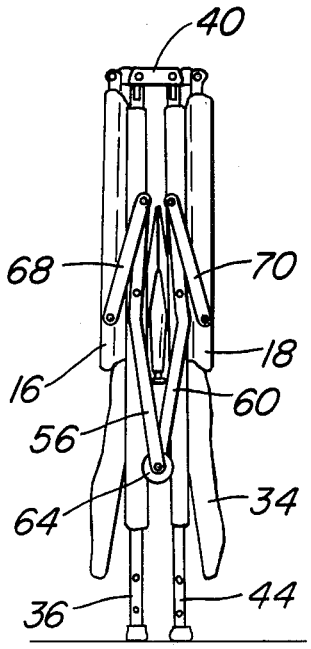
FIG. 5
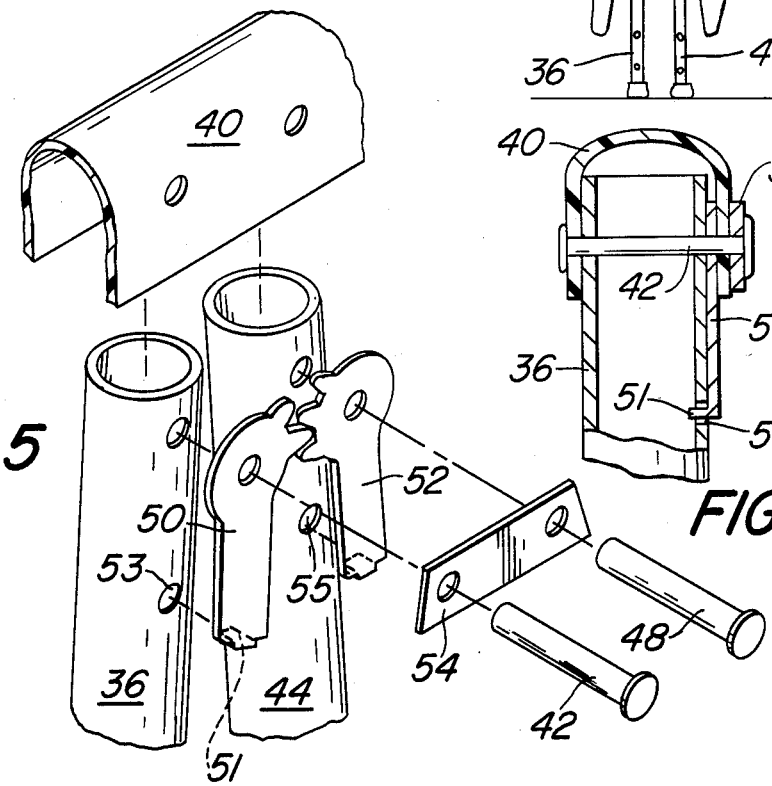
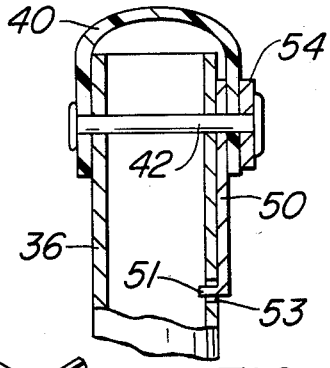
FIG. 6

FOLDING PLAYPEN

BACKGROUND

Ordinary dropside playpens have been severely criticized since they enable babies to climb or roll over the edge of the platform floor where the side is dropped and the netting is loose. That problem was solved by an arrangement which does not allow the sides to drop until the floor is folded vertical. See U.S. Pat. Nos. 3,474,472 and 3,206,773.

The prior art still has the problem of permitting one side to fold in instead of out before the operator realizes what is happening. Thus, it is possible to strain or bend some of the links.

The problem is solved by providing a positive means which causes the pivoting portions to pivot outwardly in opposite directions at the same time and through the same distance relative to a common bracket.

SUMMARY OF THE INVENTION

The folding playpen of the present invention includes two pairs of leg frames which are movable between extended and collapsed positions. Upper and lower U-shaped frame portions are indirectly pivoted to the leg frames. A flexible fence extends between said frame portions. A platform is provided and includes pivotable sections.

A means is provided for causing the frame portions and the platform sections to pivot in opposite directions at the same time as the leg frames move between their associated positions. The said means includes meshed gear means on at least one of the pairs of leg frames. Also, the said means includes angled links, each pivoted to each other and to a leg of one pair of leg frames. Each of the angle links is also pivotable connected to a frame portion by an intermediate link.

It is an object of the present invention to provide a folding playpen with a structural interrelationship which prevents one side from folding in when it should be folding out and vice versa.

Other objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 3 shows the playpen of the present invention in a partially collapsed position.

FIG. 4 shows the playpen in a fully collapsed position.

FIG. 5 is a partial exploded view of the upper end portions of legs forming part of one pair of leg frames.

FIG. 6 is a sectional view through the upper end of one frame leg.

DETAILED DESCRIPTION

Figure 1:
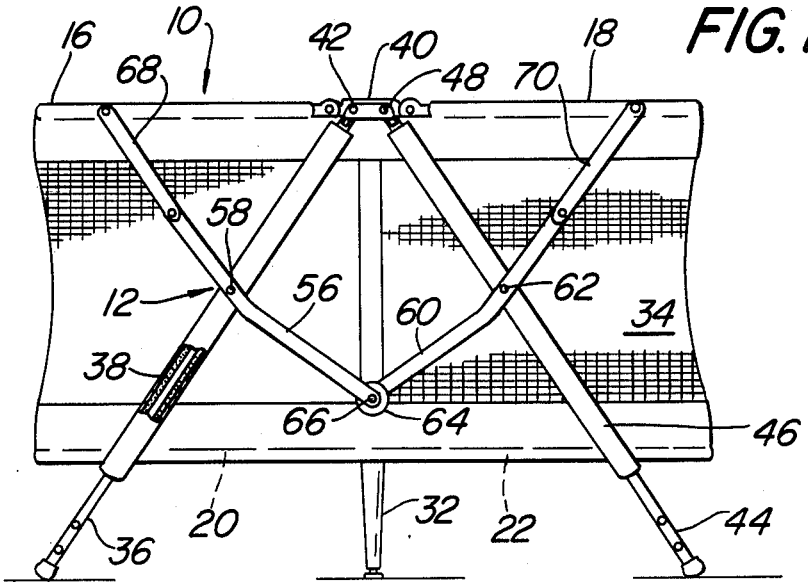
FIG. 1 is a side elevation view of a playpen in accordance with the present invention.
Figure 2:
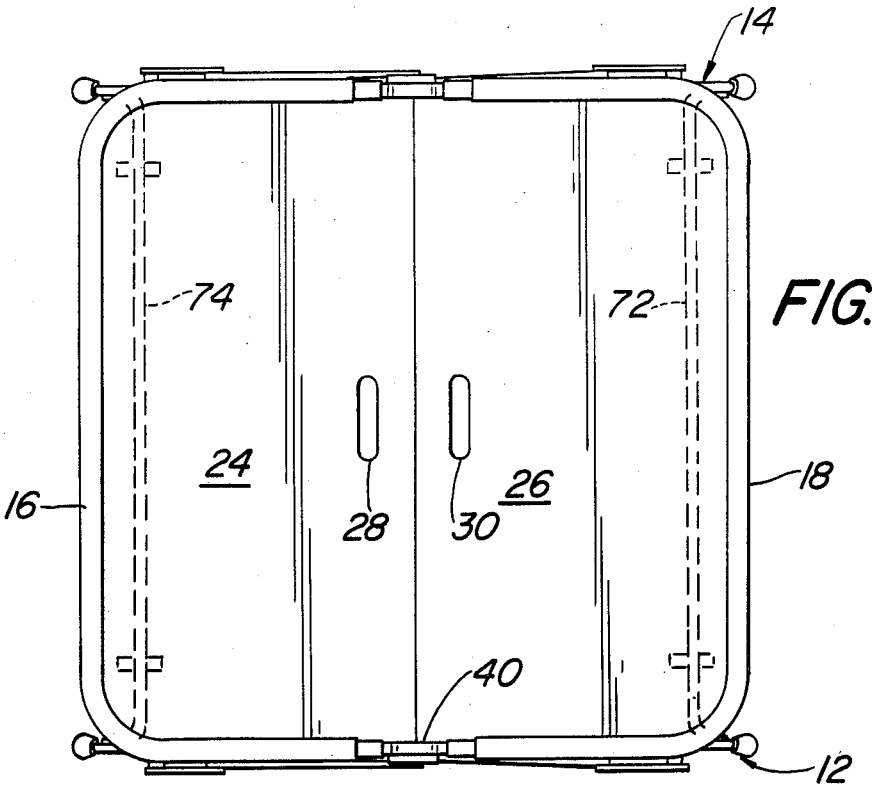
FIG. 2 is a top plan view of the playpen in the present invention.

Referring to the drawing in detail, wherein like numerals indicate like elements, there is shown in FIGS. 1 and 2 a folding playpen designated generally as 10. The playpen 10 has the following major components. On opposite sides of the playpen there is provided a first pair of leg frames 12 and a second pair of leg frames 14.

The playpen includes upper U-shaped frame portions 16 and 18 pivoted together adjacent their free ends as well as similar lower U-shaped frame portions 20, 22.

The playpen 10 includes conventional platform sections 24 and 26 attached to the pairs of leg frames. The section 24 has a slot 28 and section 26 has a slot 30. The slots 28 and 30 perform the usual function as is well-known to those skilled in the art. A flexible fence 34 extends between the upper and lower frame portions in a conventional manner.

The pairs of leg frames 12 and 14 are identical. Only the pair of leg frames 12 will be described in detail. Leg frame 12 includes a leg 36 which is surrounded along a major portion of its length by padding 38. The upper end of leg 36 is pivotably connected to a bracket 40. Bracket 40 constitutes the means for pivotably connecting the frame portions 16 and 18 to each other. As shown more clearly in FIGS. 5 and 6, the bracket 40 is U-shaped and inverted so as to be open on its bottom side. A pin 42, such as a rivet, pivotably connectes the upper end of leg 36 to the downwardly extending legs of bracket 40.

The pair of leg frames 12 includes a second leg 44. Leg 44 has padding 46 surrounding the major length thereof. The upper end of leg 44 is pivotably connected to the bracket 40 by pin 48. A means is provided to keep the legs 36, 44 and bracket 40 symmetrical while the legs move from the folded position to the unfolded position. Thus, bracket 40 remains level while the legs 36, 44 pivot. In the illustrated embodiment, such means includes the gear segments 50 and 52 fixedly secured to the upper ends of the legs 36 and 44 respectively. The number of teeth on the gear segments 50 and 52 may be increased as desired. One means for securing the gear segments to their respective legs is shown in FIGS. 5 and 6. Each gear segment has a tang 51. Tang 51 on gear segment 50 extends through a hole 53 on leg 36 while gear segment 52 has its tang extending through a hole 55 on leg 44. The gear segments are disposed between the downwardly extending legs of the bracket 40. Pin 42 extends through a hole in plate 54 and through a hole in its associated gear segment 50. Likewise, pin 54 extends through a hole in plate 54 and an associated hole in the gear segment 52. As one leg moves, the other leg must move in the opposite direction by the same amount relative to bracket 40.

The pair of leg frames 12 includes a second means for causing the frame portions 16, 18 and platform sections to pivot in opposite directions. As shown more clearly in FIGS. 1, 3 and 4, link 56 has an angled portion pivotably connected to the padded portion of leg 36 by pin 58. A similar angled link 60 is pivoted to a similar portion of leg 44 by pin 62. The lower ends of the angled links 56 and 60 are pivotably connected together by a pin 66 with a plastic washer 64 therebetween.

The upper end of angled link 56 is pivoted to one end of a link 68. The other end of link 68 is pivoted to the frame portion 16. The upper end of link 60 is pivoted to one end of a link 70. The other end of link 70 is pivoted to the frame portion 18. The distance between the upper ends of the links 68 and 70 is greater than the distance between the upper ends of links 56 and 60. Hence, the upper ends of the links 68 and 70 move downwardly as the upper ends of links 56 and 60 move toward each other. See FIG. 3.

The platform sections 24 and 26 may be pivoted to a longitudinal member which terminates in downwardly extending legs 32 in the same manner as disclosed in U.S. Pat. No. 3,206,773. Likewise, the platform sections may have braces 72 and 74 secured thereto and to the lower ends of the legs of each pair of leg frames in the same manner as set forth in the last-mentioned patent.

Thus, it will be seen that there are two different structural features which cooperate to prevent one side of the playpen from folding in when it should be folding out and vice versa. In this regard, the gear segments 50 and 52 require the legs 36 and 44 to move in opposite directions at the same time and through the same distance relative to bracket 40. Also, the angled links 56, 60 cooperate with links 68, 70 to force upper frame portions 16, 18 to pivot inwardly or outwardly at the same time. The present invention accomplishes the object of preventing inadvertant collapse and/or improper movement of components of the playpen by use of structure which is simple and relatively inexpensive.

The present invention may be embodied in other specific forms without departing from the spirit or essential attributes thereof and, accordingly, reference should be made to the appended claims, rather than to the foregoing specification, as indicating the scope of the invention.

I claim:

1. A folding playpen comprising two pairs of leg frames movable between extended and collapse positions, upper and lower U-shaped frame portions pivoted together, a flexible fence extending between said frame portions, a platform having pivotable sections, means for causing said frame portions and platform sections to pivot in opposite directions as said leg frames move between their associated positions, said means including meshed gear means on at least one of said pairs of leg frames.

2. A playpen in accordance with claim 1 wherein said gear means includes a gear segment fixed to one leg of said one pair of leg frames, said gear segment being in mesh with a second discrete gear segment secured to the other leg of said one pair of leg frames, and each of said legs and gear segments being pivoted to a bracket, each end of said bracket being pivoted to one of said upper U-shaped frame portions.

3. A playpen in accordance with claim 2 wherein a common pin couples said one leg and its gear segment to said bracket, a common pin coupling said other leg and its gear segment to said bracket.

4. A playpen in accordance with claim 2 wherein said bracket has a pair of legs between which said legs and gear segments are disposed.

5. A playpen in accordance with claim 1 wherein said first mentioned means also includes two angled links which form part of each pair of leg frames, each angled link having its lower end pivoted to a lower end of the other angled link, the upper end of each angled link being pivoted to one end of a discrete connecting link, the other end of each connecting link being pivoted to one of said upper frame portions.

6. A playpen in accordance with claim 5 wherein said means also includes meshed gears between downwardly extending legs of an inverted U-shaped bracket, each gear means being fixedly secured to a leg of a pair of leg frames at one end of the playpen, said bracket being pivotably connected at its ends to the U-shaped upper frame portions.

7. A playpen in accordance with claim 1 wherein each leg of said pairs of leg frames is padded along a major portion of its length.

8. A playpen in accordance with claim 7 wherein each leg of said pairs of leg frames is padded along at least a substantial portion of the length thereof.

9. A folding playpen comprising two pairs of leg frames movable between extended and collapsed positions, upper and lower U-shaped frame portions pivoted to said leg frames, a flexible fence extending between said frame portions, a platform having pivotable sections, means for causing said frame portions and platform sections to pivot in opposite directions as said leg frames move between their associated positions, said means including two angled links which form part of each pair of leg frames, each angled link having its lower end pivoted to a lower end of the other angled link, the upper end of each angled link being pivoted to one end of a discrete connecting link, the other end of each connecting link being pivoted to one of said upper frame portions, the distance between the upper ends of angled links being less than the distance between the locations where the connecting links are pivoted to said upper frame portions in all positions of the pairs of leg frames.

* * * * *